United States Patent [19]

Wang

[11] Patent Number: 4,989,298

[45] Date of Patent: Feb. 5, 1991

[54] STRUCTURE OF FILE CLIP

[76] Inventor: Bor-Jou Wang, 3/F No. 740, Ching Chen Road, Yung-Ho, Taipei Hsien, Taiwan

[21] Appl. No.: 533,316

[22] Filed: Jun. 5, 1990

[51] Int. Cl.[5] ..... B42F 1/02

[52] U.S. Cl. ..... 24/67 R; 24/67.3; 24/67.7

[58] Field of Search ..... 24/67 R, 67.3, 67.5, 24/67.7, 67.11

[56] References Cited

U.S. PATENT DOCUMENTS 4,506,416 3/1985 Ohminato et al. ..... 24/67.7
4,525,899 7/1985 Carroll ..... 24/67 R
4,628,572 12/1986 Chang ..... 24/67 R

FOREIGN PATENT DOCUMENTS 412169 11/1945 Italy ..... 24/67.5
442830 12/1948 Italy ..... 24/67.5

*Primary Examiner*—Victor N. Sakran
*Attorney, Agent, or Firm*—Lowe, Price, LeBlanc, Becker & Shur

[57] ABSTRACT

Disclosed is a file clip which comprises a pressure bar to drive a clamp plate to clamp on a base plate by means of the operation of a torsional spring. The clamp plate is movably secured to the base plate by two crank levers. The crank levers have each two conical portions at two opposite ends thereof and respectively made in an extended size so that they can be conveniently fastened in the fixing holes on the base plate and the positioning holes on the clamp plate to firmly secure the clamp plate to the base plate. Except the torsional spring which is made metal material, the other parts of the clip are made of plastic material through injection molding process.

2 Claims, 4 Drawing Sheets

FIG. 4A
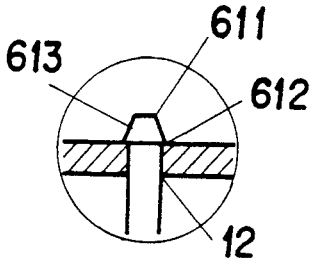
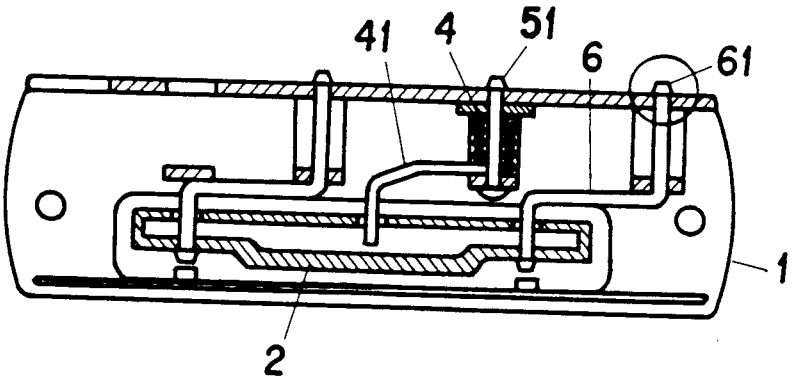
FIG. 4B

STRUCTURE OF FILE CLIP

BACKGROUND OF THE INVENTION

The present invention is related to clips and more particularly to a clip for mounting on a file to hold paper, which is generally made of plastic material through injection molding process and convenient to assemble with the hand without the use of any tool.

FIG. 1 illustrates a file clip according to the prior art, which is generally comprised of a clamp board driven by a pressure bar to clamp on a base plate by means of the operation of two crank levers and a torsional spring. The clamp board, the pressure bar, the base plate, the crank levers and the torsional spring are all made of metal material through forging and punching process. During assembly, the crank levers and the torsional spring must be movably mounted on the base plate by machinery through rivet joint. The manufacturing process of this type of file clip is complicated and dangerous. Because all the parts of this type of clip are made of metal material which shall be surface treated through electroplating process, environmental pollution is still another problem to handle

SUMMARY OF THE INVENTION

It is one object of the present invention to provide a file clip which can be substantially made of plastic material through injection molding process to minimize manufacturing cost.

It is another object of the present invention to provide a file clip which can be conveniently assembled with hands and without the use of any machinery or tool.

It is still another object of the present invention to provide a file clip which eliminates the surface treatment of electroplating process so as to prevent any possible environmental pollution.

BRIEF DESCRIPTION OF THE DRAWINGS

FIG. 4 is a partly sectional view of the present invention.

DETAILED DESCRIPTION OF THE PREFERRED EMBODIMENT

Figure 1:
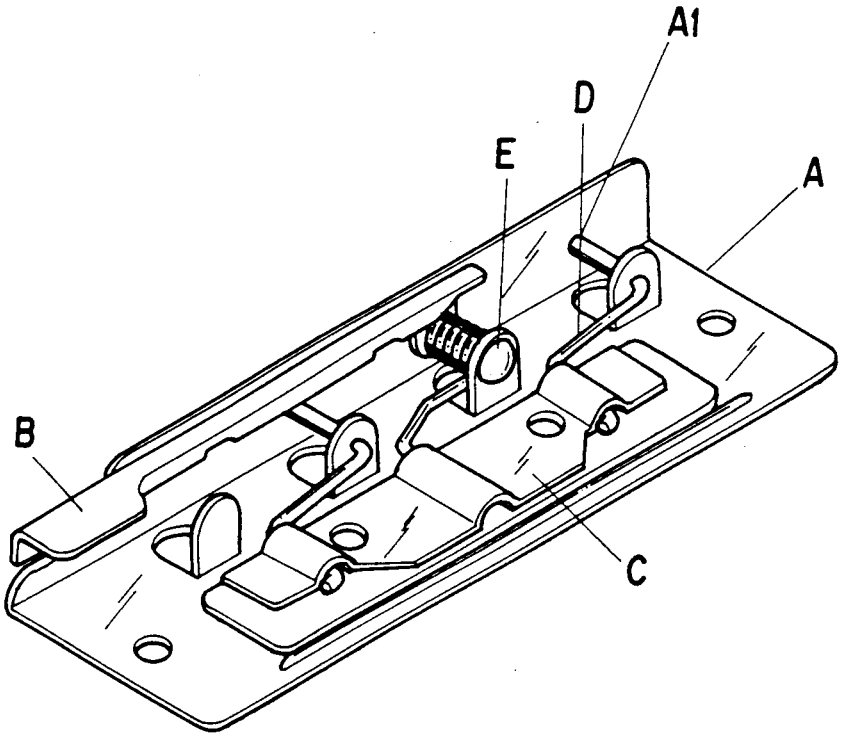
FIG. 1 PRIOR ART
FIG. 1 is a perspective view of a metal file clip according to the prior art.
Figure 2:
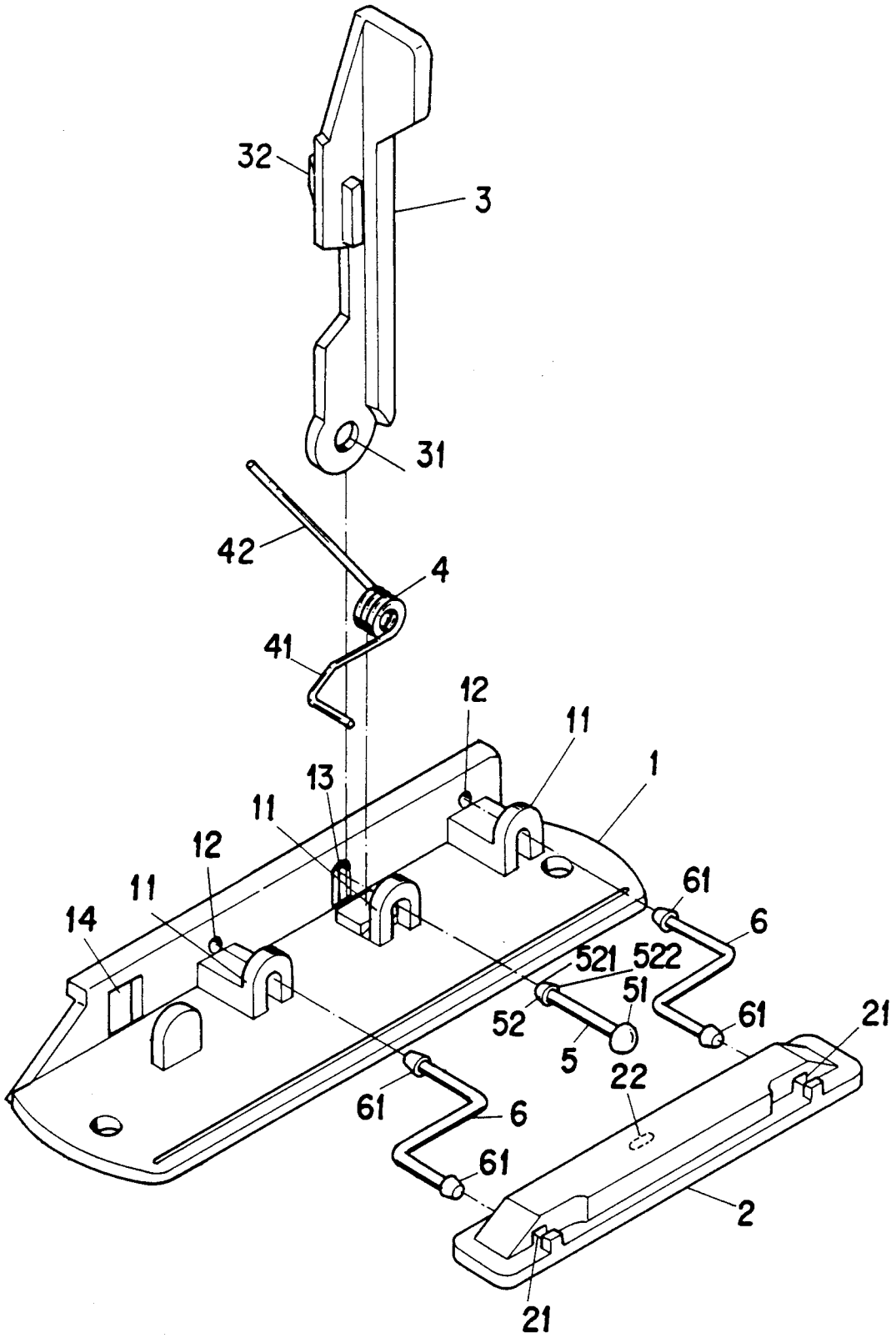
FIG. 2 a perspective exploded view of the present invention.

Referring to FIG. 2, there is illustrated a file clip according to the present invention, which is generally comprised of a base plate 1, a clamp plate 2, a pressure bar 3, a torsional spring 4, a torsional spring mounting axle 5 and two crank levers 6. The base plate 1 comprises three seats 11 respectively for the two crank levers and the torsional spring mounting axle, two fixing holes 12 and a fixing notch 13 for fastening the crank levers and the torsional spring mounting axle, and a locking hole 14 for securing the pressure bar. The clamp plate 2 comprises two positioning holes 21 and a guide hole 22. The pressure bar 3 comprises an axle hole 31 and a lock bolt 32. The torsional spring 4 comprises a straight guide rod portion 41 at one end and a driving rod portion 42 at an opposite end. The torsional spring mounting axle 5 comprises a semi-spherical portion 51 at one end and made in an extended size and a conical portion 52 at an opposite end and also made in an extended size, in which the conical portion 52 has a smaller diameter 521 disposed at the outer side and a larger diameter 522 at the inner side. The two crank levers 6 are identical and have each two conical portions 61 at two opposite ends thereof and respectively made in an extended size.

Figure 3A:
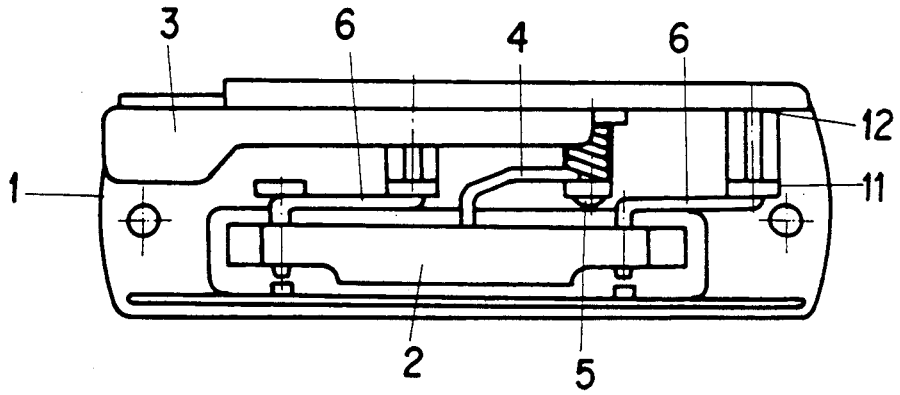
FIG. 3 a top view and an elevational view of the present invention.
Figure 3B:
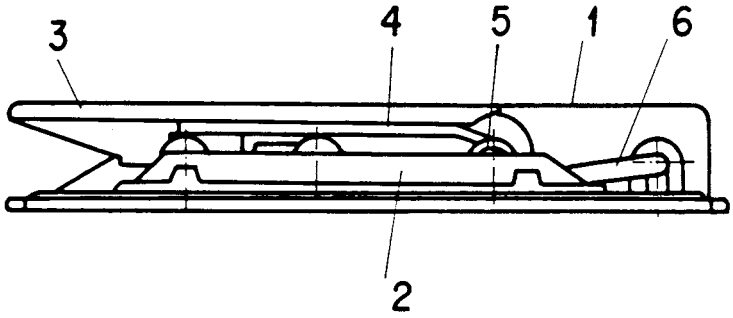

It is easy to assemble the afore-said parts into a file clip with hands. The pressure bar 3, the torsional spring 4 and the torsional spring mounting axle 5 can be mounted on the base plate 1 at first or the clamp plate 2 and the crank levers 6 may be first assembled. The following is an example in assembling the parts into a file clip. Place the pressure bar 3 on the base plate 1 with the axle hole 31 disposed between the intermediate seat 11 and the fixing notch 13. Then, set the torsional spring 4 between the pressure bar 3 and the intermediate seat 11 with the driving rod portion 41 of the torsional spring 4 inserted through the intermediate seat 11 permitting the torsional spring 4 to be connected with the axle hole 31 of the pressure bar 3 in series. The mounting axle 5 is then inserted through the intermediate seat 11, the torsional spring 4, the axle hole 31 of the pressure bar 3 with its conical portion 52 fastened in the fixing notch 13 so as to firmly secure the pressure bar 3 and the torsional spring to the base plate 1. Then, the two crank levers 6 are respectively inserted through the front and rear seats 11 and fastened in the two fixing holes 12. The opposite ends of the two crank levers 6 are further set in the two positioning holes 21 of the clamp plate 2 respectively. At the same time, set the guide rod portion 41 of the torsional spring 4 in the guide hole 22 of the clamp plate 2. Thus, the assembly is completed and presented as shown in FIG. 3.

The main feature of the present invention is the design of the conical portions 52 and 61 of the mounting axle 5 and the crank levers 6. As shown in FIG. 4, the conical portions 52 and 61 have each a tapered surface 523 or 613 so that they can be conveniently inserted in the fixing holes 12 of the base plate 1. The inner side 522 or 612 of the conical portions 52 and 61 has a wider diameter slighter larger than the boring bore of the fixing holes 12 or the width of the fixing notch 13. Therefore, after the mounting axle 5 and the crank levers 6 are inserted in the fixing notch 13 or the fixing holes 12, the conical portions 52 and 61 are respectively stopped at the outer side of the base plate 1 and the mounting axle 5 and the crank levers 6 become firmly secured to base plate 1.

As described above, the present invention is to provide such a file clip having numerous features each of which tends to make the structure more inexpensive to manufacture and more easy to assemble.

What is claimed:

1. A file clip, comprising:

a base plate having made thereon three unitary seats, two fixing holes, a fixing notch, and a locking hole;

a clamp plate having made thereon two positioning holes and a guide hole;

a pressure bar having made thereon an axle hole and a lock bolt;

a torsional spring comprising an unitary straight guide rod portion at one end and an unitary driving rod portion at an opposite end;

a mounting axle having an unitary semi-spherical portion at one end and made in an extended size and a conical portion at an opposite end and made in an extended size, said conical portion having a smaller diameter disposed at the outer side and a larger diameter at the inner side; and two crank levers having each two conical portions at two opposite ends and respectively made in an extended size;

wherein said base plate, said clamp plate, said pressure bar, said mounting axle and said crank levers are respectively made of plastic material through injection molding process and said torsional spring is made of metal material.

2. The file clip of claim 1, wherein said conical portions of said mounting axle and said crank levers have each a tapered surface with the end of smaller diameter disposed at an outer side and the end of larger diameter disposed at an inner side.

* * * * *